United States Patent [19]

Ikebuchi et al.

[11] Patent Number: 4,754,934

[45] Date of Patent: Jul. 5, 1988

[54] VERTICAL GRINDING MILL

[75] Inventors: Iwao Ikebuchi, Hirakata; Mamoru Nakano, Kadoma, both of Japan

[73] Assignee: Kubota, Ltd., Osaka, Japan

[21] Appl. No.: 17,685

[22] Filed: Feb. 24, 1987

[30] Foreign Application Priority Data

Jan. 23, 1987 [JP] Japan ..... 62-9025

[51] Int. Cl.[4] ..... B02C 17/16

[52] U.S. Cl. ..... 241/69; 241/171; 241/172

[58] Field of Search ..... 241/171, 172, 57, 79, 241/69, 70

[56] References Cited

FOREIGN PATENT DOCUMENTS

| | | | |
|---|---|---|---|
| 1183344 | 12/1964 | Fed. Rep. of Germany | 241/172 |
| 5584 | 4/1925 | Japan . | |
| 1204813 | 9/1970 | United Kingdom | 241/172 |
| 594294 | 2/1978 | U.S.S.R. | 241/172 |

*Primary Examiner*—Mark Rosenbaum

*Attorney, Agent, or Firm*—Wenderoth, Lind & Ponack

[57] ABSTRACT

An improved vertical grinding mill is proposed which comprises a shell, a vertical screw shaft rotatably mounted in the shell, a classifying means, a drive for the screw shaft, and means for forming a current of fluid for taking fine particles out of the shell. The inlet for the fluid is provided in the center of the bottom of the shell directly under the screw shaft. The fluid is uniformly distributed in all directions, carrying up the pulverized fine particles.

4 Claims, 3 Drawing Sheets

VERTICAL GRINDING MILL

This invention relates to a vertical grinding mill.

A conventional grinding mill of this type disclosed in the Japanese patent publication No. 39-5584 is shown in FIG. 4. A vertical screw shaft 2 is rotatably mounted in a vertical shell 1. Grinding medium b such as steel balls is filled in the shell 1. While rotating the screw shaft 2, the material a to be pulverized is fed into the shell. The material is pulverized into fine particles by friction between the material and the grinding medium. The fine product particles c are carried away by air or water current out of the shell 1. On this conventional grinding mill, the air or water current is introduced through an opening in the side wall of the shell into the bottom of the shell 1 and leaves the shell at its top together with the fine articles. As the current is blown into the shell from one side of its bottom, the product particles will be unevenly distributed as shown in FIG. 5 with a broken line and thus will not be smoothly discharged out of the shell. Therefore, the production efficiency is relatively low and the capacity is small for a relatively large apparatus size.

Another grinding mill shown in FIG. 5 is disclosed in U.S. patent application No. 786,547, filed Oct. 11, 1985, and now U.S. Pat. No. 4,660,776, entitled "Vertical Grinding Mill." It comprises a hollow screw shaft 2 rotatably mounted and adapted to cause a fluid to flow down through the screw shaft and spread uniformly in all directions from the open bottom end of the screw shaft into the shell 1. That arrangement assures a uniform distribution of the material to be treated, thus solving the abovementioned problem. However, that grinding mill has a shortcoming that various members for driving the screw shaft and for feeding a fluid thereinto have to be mounted on the top end of the screw shaft which projects beyond the top end of the shell. This complicates the structure of the grinding mill.

An object of the present invention is to provide improved vertical grinding mills which assure a uniform distribution of the particles in the shell without the necessity of mounting many members on the screw shaft.

In accordance with the present invention, there are provided vertical grinding mills having an inlet for the fluid for carrying the product particles in the center of the bottom wall of the shell.

While rotating the screw shaft, the material to be pulverized is fed into the shell of the grinding mill as described above. The material is pulverized into fine particles by friction between the material and the grinding medium. When an air or water current is blown into the shell through the inlet in the bottom of the shell, it flows up in the shell and leaves the shell at its top carrying the product particles.

Other features and objects of the present invention will become apparent from the following description taken with reference to the accompanying drawings, in which.

[First Embodiment]

Figure 1:
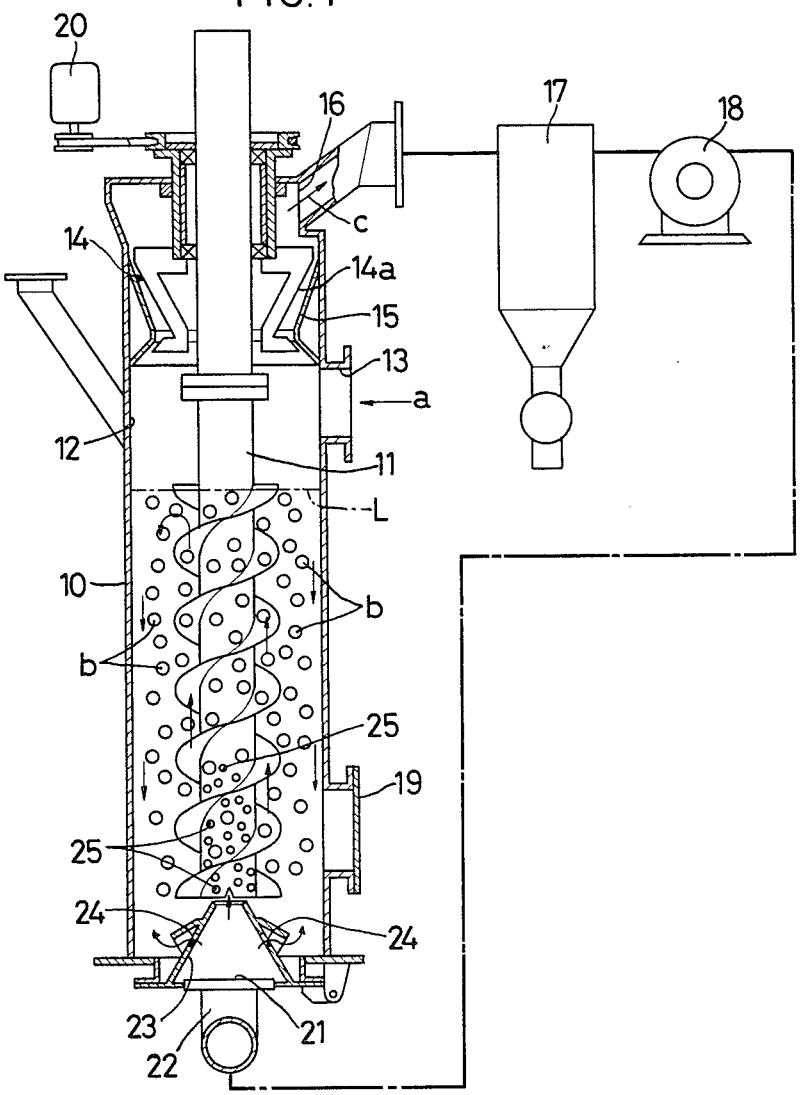
FIGS. 1 and 2 are vertical sectional views of the first, second and fourth embodiments.

Referring first to FIG. 1, a vertical grinding mill comprises a vertical cylindrical shell 10 having its top and bottom walls closed, and a screw shaft 11 supported in the cylindrical shell 10 by means of a thrust bearing or the like. The screw shaft 11 extends through the top wall of the shell 10 and is rotated by a motor (not shown). The screw shaft 11 is hollow at part of its lower portion and is formed with a plurality of small openings 25 at the lower portion to adjust or retard the speed at which the fluid flows out of the bottom of the screw shaft 11. The number and position of the small holes may be decided as necessary. The small holes may be omitted.

The shell 10 is provided at its upper portion with an inlet 12 for the grinding medium b and an inlet 13 for the material a to be pulverized. Through the inlet 12, the grinding medium such as ceramic, gravel or steel balls is supplied into the shell 10 up to the level L in FIG. 1. Through the inlet 13, the material to be pulverized is fed into the shell 10 by a screw conveyor or the like, keeping airtightness. As the screw shaft 11 rotates, the grinding medium b and the material a to be pulverized are agitated in the direction of the unnumbered arrow. As a result, the material is pulverized to fine particles c by friction between the material and the grinding medium.

At the upper portion of the shell 10, a vane wheel 14 having blades 14*a* arranged at circumferentially equal intervals is rotatably mounted on the screw shaft 11. An annular member 15, triangular in section, is provided over the entire circumference of the inner wall of the shell 10 so as to be opposed to the vane wheel 14. When a motor 20 rotates the vane wheel 14, a swirling force is given to the air current passing between the vane wheel 14 and the annular member 15, so that the product particles are classified.

Above the vane wheel 14 is formed a suction port 16 to which a suction fan 18 is connected through a product collector 17 such as a back filter or a cyclone.

In the center of the bottom wall of the shell 10 is formed an air inlet 21 to which an air supply pipe 22 is connected. Over the air inlet 21, a truncated conical member 23 is provided. When the suction fan 18 is started, the inside of the shell 10 will be put under negative pressure, so that the air current is admitted into the shell 10 through openings 24 in the member 23. The air current flows into the screw shaft 11, too, and through small holes 25 into the shell 10 and spread uniformly all around the shell. An outlet 19 is provided to take the grinding medium out of the shell 10.

In operation, when the screw shaft 11 starts to rotate and the material to the pulverized is fed into the shell 10, the shaft 11 will agitate the material and the grinding medium, so that the material a will be pulverized to fine particles c by friction between them.

On the other hand, when the suction fan 18 is started, air will flow through the air inlet 21 into the bottom of the shell 10 and spread uniformly in all directions. This air current will flow up in the shell 10, swirling up between the vane wheel 14 and the member 15. The air current passing therebetween carries up the fine particles, which pass through the suction port 16 out of the shell 10 and are collected in the collector 17. Coarse particles are separated by the swirling force produced by the vane wheel 14.

Since the air admitted through the member 23 spreads uniformly in all directions and agitates the grinding medium and the material to be pulverized, they will not stay at the same position.

[Second Embodiment]

Figure 2:
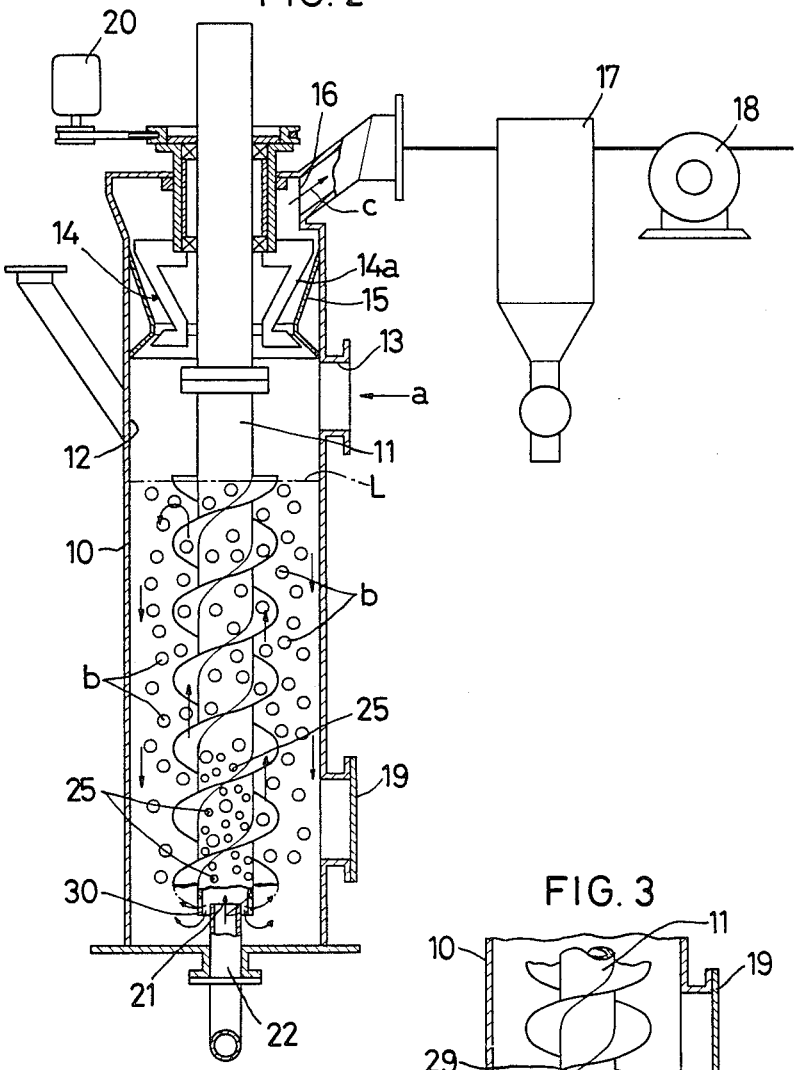

In this embodiment (See FIG. 2), the conical member 23 in the first embodiment is not provided and instead the top end of the air supply pipe 22 is within and above the lower end of the screw shaft 11. A plurality of vertical slits 30 are formed in the screw shaft 11 at its bottom end at angular spacings. These slits perform the same function as the small holes 25. This arrangement assures that an air current is uniformly distributed radially in all directions from the bottom end of the screw shaft into the shell. Numeral 21 designates an air inlet.

[Third Embodiment]

Figure 3:
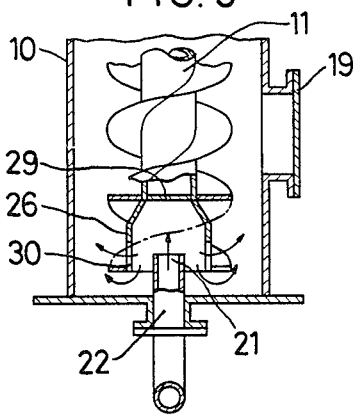
FIG. 3 is a vertical sectional view of a portion of the third embodiment.
Figure 4:
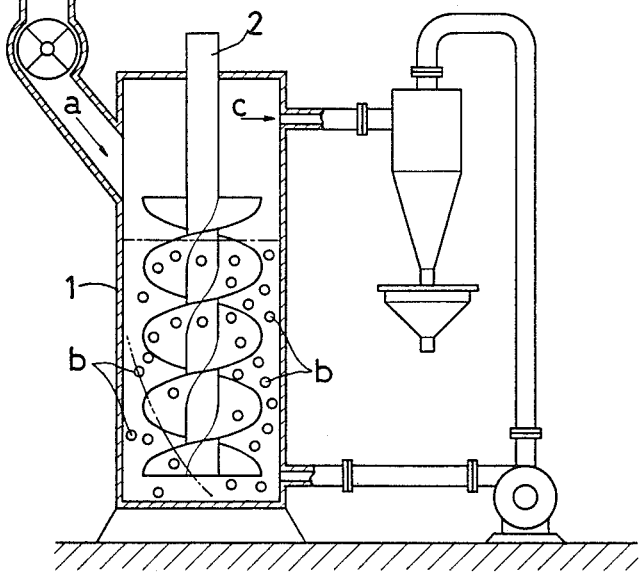
FIG.4 PRIOR ART
FIGS. 4 and 5 are vertical sectional views of PRIOR ART grinding mills.
Figure 5:
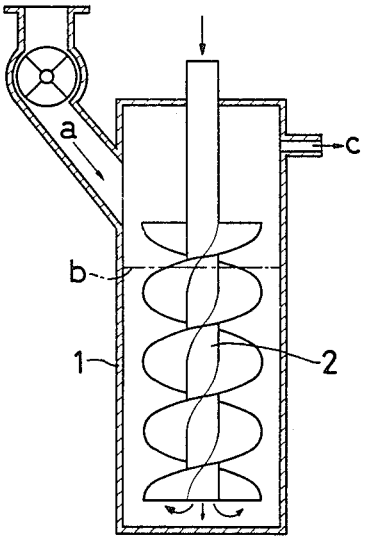
FIG.5 PRIOR ART

As shown in FIG. 3, in this embodiment, the screw shaft 11 has an enlarged portion 26 at its bottom end to form an air reservoir. Numeral 29 designates a plate for blocking the air current into the screw shaft 11. The air from the air supply pipe 22 gathers in the air reservoir and then flows out of the lower end of the screw shaft into the shell 10 uniformly in all the directions. The same result will be obtained if such an air reservoir is formed at the bottom of the screw shaft in the first embodiment.

In any of the embodiments, pulverization under a dry condition is possible if hot air is introduced into the shell. The fluid for carrying the product particles c may be any other gas than air or a liquid such as water.

The air outlet of a suction fan may be connected to the inlet port of the air supply pipe 22 to form a closed circuit. In this case, it is preferable to supply about two-thirds of the entire volume from the suction fan to the air supply pipe 22 so that even if the inside of the air supply pipe 22 is under positive pressure, the inside of the shell 10 will be kept under negative pressure. In this closed-circuit operation using air as the fluid, if the air becomes saturated with water, part of the exhaust of the suction fan 18 may be discharged and fresh air be supplied from the outlet from the air supply pipe 22 under the screw shaft 11 to make up for the discharged volume.

Although with the above embodiments, the inside of the shell 10 was out under negative pressure, it is naturally possible to gain a beneficial effect of the present invention with the inside of the shell 10 put under positive pressure by feeding pressurized fluid through the inlet 21 into the shell.

What is claimed is:

1. A vertical grinding mill comprising a shell for containing material to be pulverized and grinding medium;

material inlet means for supplying material to be pulverized into the upper portion of said shell;

a vertical screw shaft rotatably mounted in said shell and extending through a top wall of said shell;

means connected to said screw shaft for driving said screw shaft to agitate the material and the grinding medium and pulverize the material into the fine particles;

classifying means at the top of said shell for collecting the fine particles;

fine-particle-containing fluid outlet means for discharging fine particles and fluid from an upper portion of said shell;

fluid inlet means provided substantially in the center of the bottom of said shell for supplying fluid into the lower portion of said shell;

means for forming a fluid current for taking the fine particles out of the shell through said fine-particle-containing outlet means; and said fluid inlet means and said fluid current forming means directing the fluid substantially upwardly within said shell, moving the fine particles toward the upper portion of said shell, and in a direction substantially opposite to the initial direction of the material supplied by said material inlet means.

2. A vertical grinding mill as in claim 1, wherein said screw shaft is hollow at least at the lower end thereof and has an open end at said lower end thereof, a plurality of fluid outlet holes are provided in the wall of the hollow part of said shaft, and said fluid inlet means has means for directing at least part of the fluid into said open end of the hollow part of said shaft and out of said plurality of fluid outlet holes.

3. A vertical grinding mill as in claims 1 or 2, wherein said shaft has an enlarged portion at the lower end thereof, and said fluid inlet means has means for directing fluid into said enlarged portion.

4. A vertical grinding mill as in claim 3, wherein said enlarged portion has a deflector means therein for directing fluid from said fluid inlet means outwardly and circumferentially of said deflector means.

* * * * *